US005915807A

United States Patent [19]

Ilagan

[11] Patent Number: 5,915,807

[45] Date of Patent: Jun. 29, 1999

[54] ALL-IN-ONE DRAWING APPARATUS

[76] Inventor: Artemio M. Ilagan, P.O. Box 1815, Agana, Guam 96932

[21] Appl. No.: 09/144,093

[22] Filed: Aug. 31, 1998

[51] Int. Cl.[6] ..... B43L 7/10

[52] U.S. Cl. ..... 33/471; 33/470; 33/425; 33/32.3

[58] Field of Search ..... 33/471, 18.1, 18.2, 33/19.2, 23.04, 32.1, 32.3, 41.1, 45, 424, 425, 426, 448, 465, 470, 472, 473, 490, 495, 496, 497, 498, 499, 500, 430, 468, 469, 534, 535

[56] References Cited

U.S. PATENT DOCUMENTS

| | | | |
|---|---|---|---|
| 634,836 | 10/1899 | Rich | 33/430 |
| 744,963 | 11/1903 | Frantz | 33/425 |
| 1,290,343 | 1/1919 | Posner | 33/430 |
| 1,346,409 | 7/1920 | Lucas | 33/473 |
| 3,795,053 | 3/1974 | Burke . | |
| 3,835,542 | 9/1974 | DeMathe . | |
| 3,925,899 | 12/1975 | Hesse et al. . | |
| 4,004,347 | 1/1977 | Hesse et al. . | |
| 4,351,117 | 9/1982 | Wade . | |
| 4,462,168 | 7/1984 | Lynch et al. . | |
| 4,490,921 | 1/1985 | Woods et at. . | |
| 4,899,454 | 2/1990 | Francis . | |
| 4,918,822 | 4/1990 | Levitt . | |
| 5,628,118 | 5/1997 | Rivera | 33/471 |

FOREIGN PATENT DOCUMENTS

| | | | |
|---|---|---|---|
| 1514972 | 1/1968 | France | 33/430 |

*Primary Examiner*—Diego Gutierrez
*Assistant Examiner*—Andrew Hirshfeld
*Attorney, Agent, or Firm*—Richard C. Litman

[57] ABSTRACT

An all-in-one drawing apparatus has a protractor integrated with horizontal and vertical rulers on a drawing board. The vertical ruler has a pen holder adapted to move and scribe within the vertical ruler. The vertical ruler can pivot according to measured angles on the protractor portion.

12 Claims, 5 Drawing Sheets

ALL-IN-ONE DRAWING APPARATUS

BACKGROUND OF THE INVENTION

1. Field of the Invention

The present invention relates to an all-in-one drawing apparatus which has a protractor integrated with horizontal and vertical rulers on a drawing board. The protractor slides on the horizontal ruler which acts as T-square being slidably attached to both ends of the board. The vertical ruler can pivot according to measured angles on the protractor portion and incorporates a pen in a holder adapted to move within a slot in the vertical ruler.

2. Description of the Related Art

The related art of interest describes various drawing board implements, but the art neither teaches nor suggests the all-in-one drawing apparatus of the present invention. The related art will be discussed in the order of perceived relevance to the present invention.

U.S. Pat. No. 3,795,053 issued on Mar. 5, 1974, to Dennis A. Burke describes a circular transparent combination drawing instrument containing features of a protractor, compass, ruler, and a triangle. The flat disc has its peripheral edge divided into degrees with degree marking holes at 5° intervals. Sight guide lines define a series of concentric squares symmetrical about the center guide hole. The disc is subdivided into 45° segments by straight rows of guide holes radiating from the center guide hole. It is suggested that the disc can be rotatably mounted within a circular member of a base member having a base surface flush with the base surface of the disc and with the base member provided with a straight edge. The utility of such a device would be that it would incorporate the straight edge required to construct lines and require only one pencil to construct circles. The suggested device is distinguishable because the disc is rotatable on the straight edge to draw circles.

U.S. Pat. No. 3,835,542 issued on Sep. 17, 1974, to Leslie L. DeMathe describes a mobile integral drafting instrument comprising a straight edge having a first clutch mechanism to provide vertical movement thereof on a drawing media, and a second clutch mechanism to provide a circular movement thereof for drawing free and predetermined angles, straight lines and curved lines without the aid of additional instruments. The drafting instrument is distinguishable for its clutch mechanims not required in the present invention.

U.S. Pat. No. 4,899,454 issued on Feb. 13, 1990, to John G. R. Francis describes a perspective drawing machine for a drafting table which includes vertical and horizontal straight edged supports together with drive mechanisms. The drafting machine is distinguishable for its drive mechanisms.

U.S. Pat. No. 3,925,899 issued on Dec. 16, 1975, and U.S. Pat. No. 4,004,347 issued on Jan. 25, 1977, to Sarah Hesse et al. describe a graphics instrument including a pair of coplanar scale members mounted for concentric mutual rotation. The outer scale member can be square or octagonal shaped with both members having extended ruled arms. One embodiment has releasable arms and locked with eccentric cam locks so as to function as a T-square. The devices are distinguishable for reliance on two concentric rotating members.

U.S. Pat. No. 4,351,117 issued on Sep. 28, 1982, to Earl R. Wade describes a drawing board apparatus designed for scaling off with a rose plate having its central axis centered on the drawing board which has a carriage frame supporting horizontal first and second drawing bars connected by vertical pivoting links. The first drawing bar suspends a T-square vertically. The second drawing bar has a scale strip. The apparatus is distinguishable for its centered rotating rose plate and the pair of linked drawing bars.

U.S. Pat. No. 4,462,168 issued on Jul. 31, 1984, to Thomas J. Lynch et al. describes a variable angle straight edge comprising an elongated rectanglar transparent plastic body with a printed, etched or scribed trapezoidal protractor proximate the left end having a wider width or offset for placing the pen for the origin. The device can be used upside down or made also for a left-handed draftsperson by placing the offset at the opposite end. The device is distinguishable for its limitation to drawing oblique lines without the use of a T-square.

U.S. Pat. No. 4,490,921 issued on Jan. 1, 1985, to William D. Woods et al. describes a six inch long drafting tool which is rectangular, transparent and scribed with different linear scales on opposite edges. A trapezoidal protractor is centered and based on the bottom scales. Cutouts for circles are on one side and squares, French curves, a triangle, and arrowhead points are on the opposite side. The tool is distinguishable for its combination of cutouts for geometrical figures with linear scales and a protractor.

U.S. Pat. No. 4,918,822 issued on Apr. 24, 1990, to Semond Levitt describes a perspective drafting apparatus combined with a drafting machine and board. A centerpiece has the conventional drafting machine and vertical scale in addition to a pair of slidable straight edges pivotally connected. The drafting board has wing pieces on each side with vertically spaced holes for perspective drawing. The elaborate drawing board with the centerpiece is distinguishable for its multiple elements and the absence of a protractor.

None of the above inventions and patents, taken either singularly or in combination, is seen to describe the instant invention as claimed. Thus, an all-in-one drawing board solving the problem of obtaining accurate angled lines without resorting to manual manipulation of the drawing pen and the use of a separate protractor or triangles is desired.

SUMMARY OF THE INVENTION

An all-in-one drawing apparatus has a protractor integrated with horizontal and vertical rulers on a drawing board. The vertical ruler has a pen holder adapted to move within the vertical ruler. The vertical ruler can pivot according to measured angles on the protractor.

Accordingly, it is a principal object of the invention to provide an all-in-one drawing apparatus.

It is another object of the invention to provide an all-in-one drawing apparatus with an integrated protractor, a vertical ruler and a horizontal ruler.

It is a further object of the invention to provide an all-in-one drawing apparatus with a pivoting vertical ruler measuring specific angles from the horizontal.

Still another object of the invention is to provide an all-in-one drawing apparatus with a pen holder slidable in the vertical ruler.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

The present invention provides an all-in-one drawing apparatus which enables a draftsperson to accurately and efficiently mark lines at any angle for perspective views on a drawing sheet. This ability is invaluable in terms of time and effort for a draftsperson. Moreover, the inclusion of a pen holder eliminates possible human errors by providing a stable position of the pen.

Figure 1:
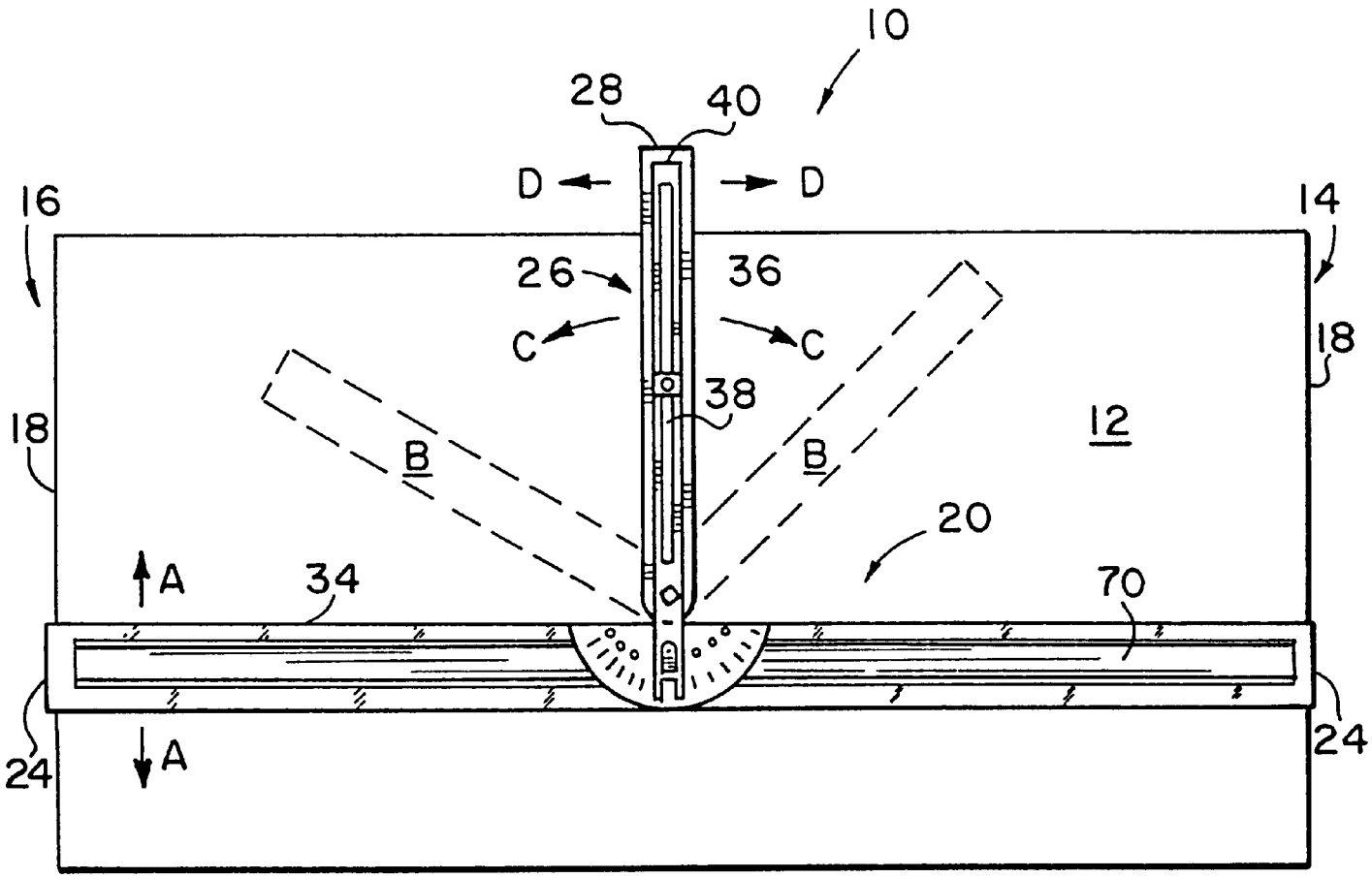
FIG. 1 is an elevational front view of the all-in-one drawing apparatus according to the present invention.

In FIG. 1, an all-in-one drawing apparatus 10 is illustrated with a rectangular drawing board 12 having its opposite ends 14 (right end) and 16 (left end) perpendicular to a horizontal axis and bolstered with a holding edge 18 which can be planar or can alternately include a groove (not shown). A flat rectangular ruler 20 is disposed horizontally on and co-extensive with the drawing board 12 and has a holding means 22 on each end 14 and 16. The holding means can be a lip 24 with or without a projection or tongue (not shown) for cooperation with a groove (not shown) in the ends 14 and 16 of the board 10. As shown by the arrows A, the up and down motion of the horizontal ruler 20 is constrained to accurately remain horizontal and perpendicular at all times to the ends 14 and 16. It should be noted that the width of the ruler 20 should be wide enough to eliminate any play on the board 10.

Figure 5:
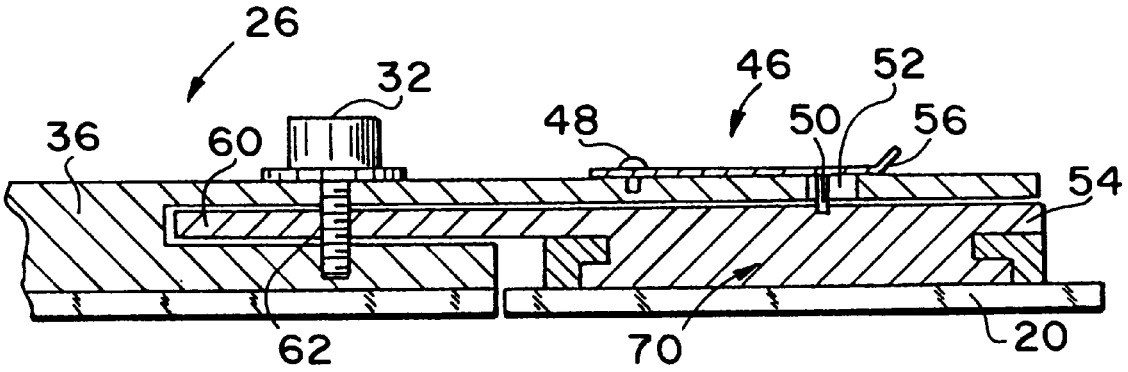
FIG. 5 is a partial cross-sectional view of the junction of the vertical ruler and the horizontal ruler along line 5—5 of FIG. 2.

As seen in FIGS. 1 and/or 2, a vertically disposed flat ruler 26 having a square distal end 28 and a rounded proximate end 30 abuts and pivots via pivot pin 32 on the top flat edge 34 of the horizontal ruler 20 to the shadowed positions B shown on either side as exemplary positions. The vertical ruler 26 can travel along the horizontal ruler 20 as shown by arrows C and D by means to be explained. The vertical ruler 26 has attached thereto a contiguous centered strip portion 36 on its upper surface with a center slot 38 which aligns with a slotted aperture 90 in the ruler 26. The square distal end 40 of the strip portion 36 is proximate the distal end 28 of the underlying vertical ruler 26 (FIG. 1). The opposite proximate end 42 of the strip portion 36 extends beyond the round proximate end 30 of the vertical ruler 26 and includes a notch 44 with an index mark 45 for alignment of the protractor value with the vertical ruler 26. Proximate to the notch 44, a locking tab 46 made of spring steel is attached to the strip portion 36 by a fastener 48 and includes a locking pin 50 for penetrating angle designating apertures 52 of the protractor 54 as best shown in FIG. 5. A lip 56 of the locking tab 46 provides a grip for moving the locking pin 50 to an appropriate angle aperture 52.

Figure 2:
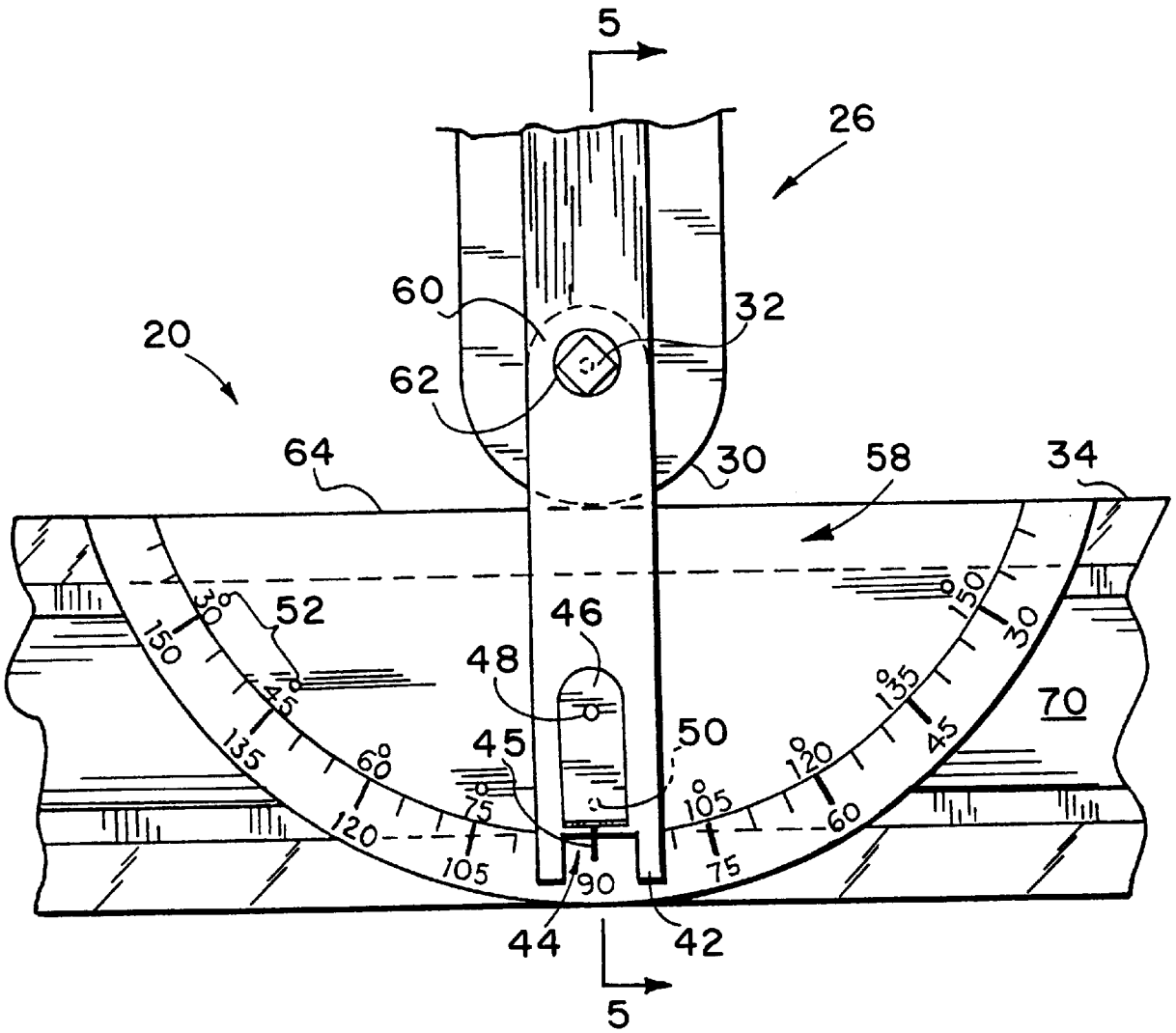
FIG. 2 is a partial elevational front view of the junction of the vertical and horizontal rulers.
Figure 3A:
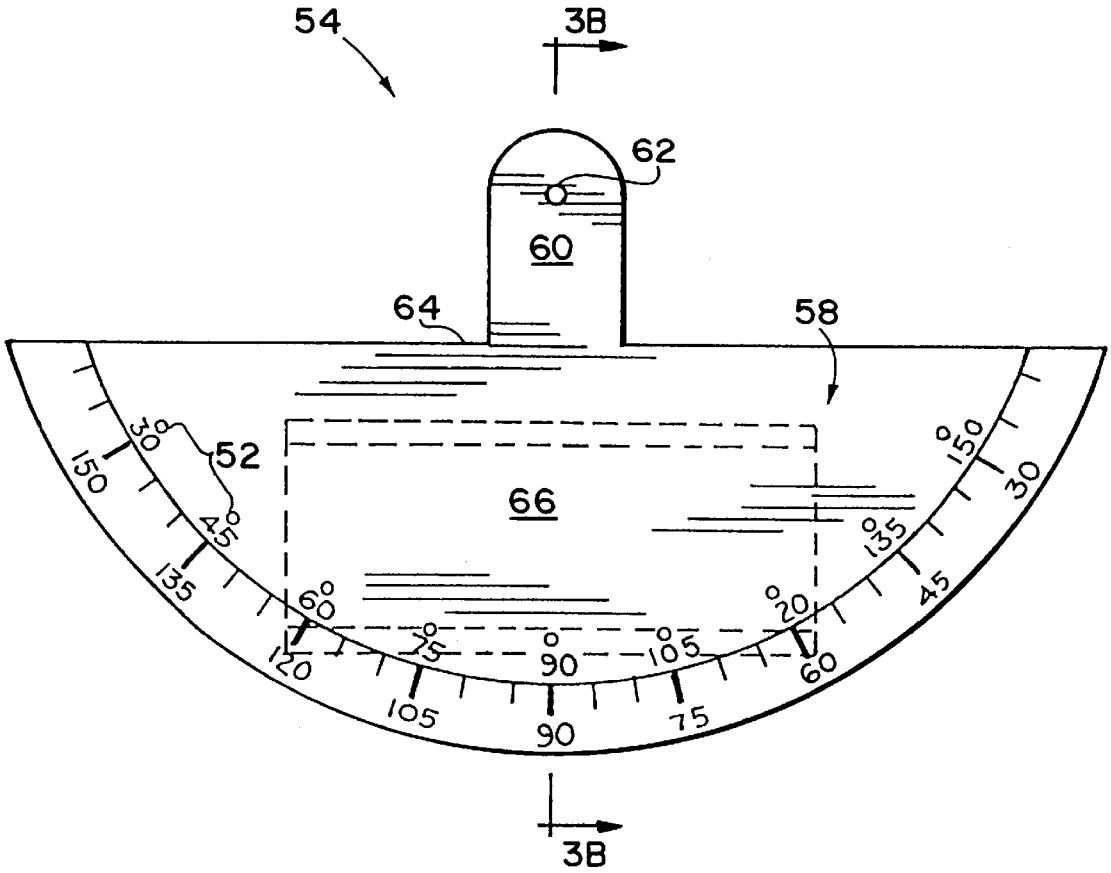
FIGS. 3A and 3B are an elevational front view and a left side view, respectively, of the protractor.
Figure 3B:
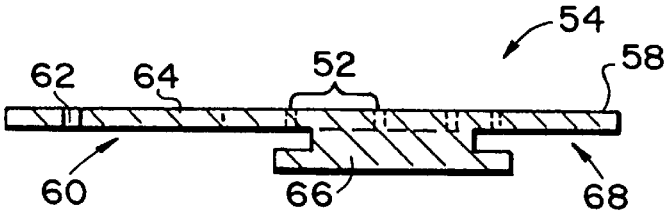
Figures 4A, 4B, 4C:
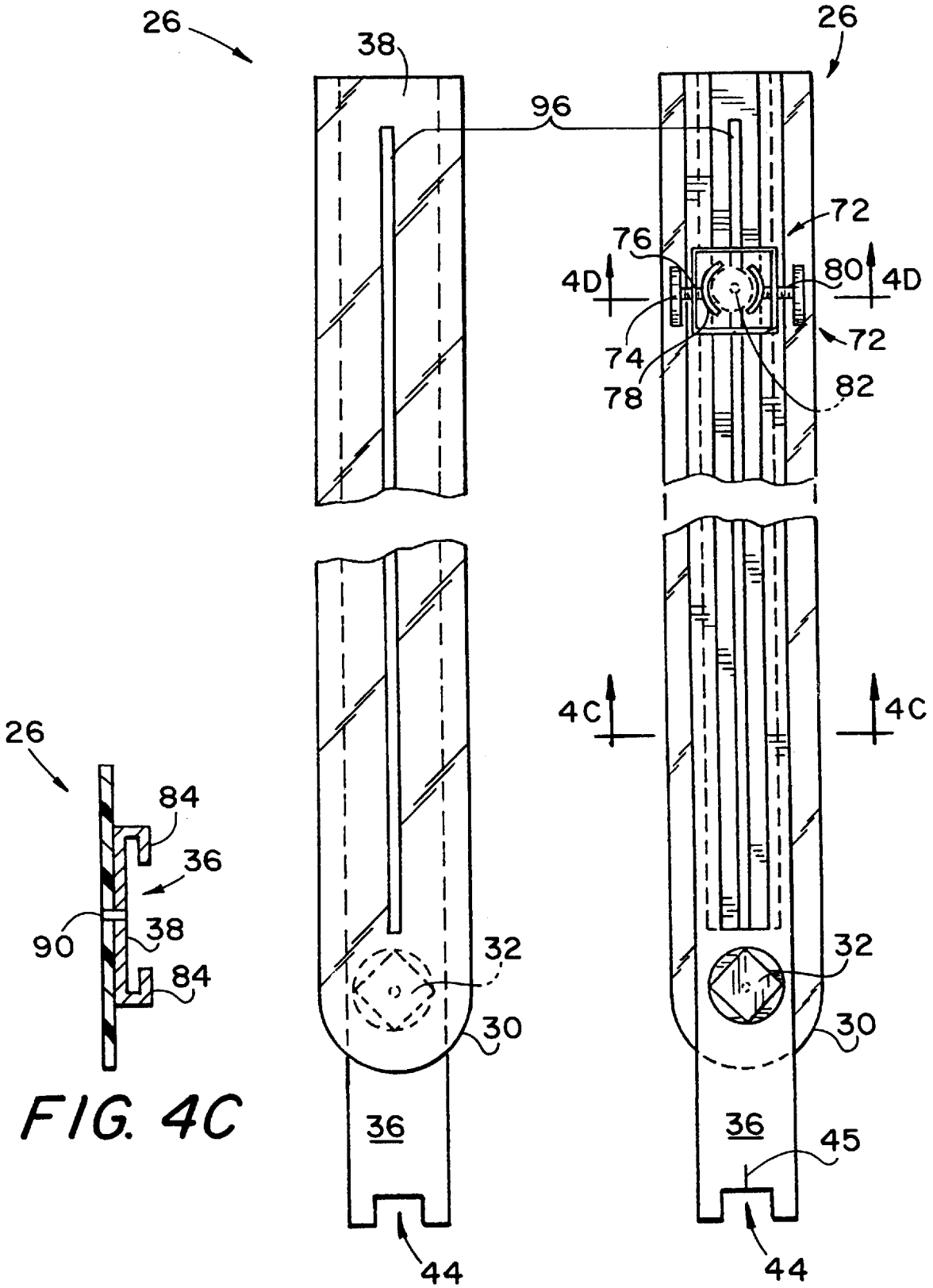
FIGS. 4A and 4B are, respectively, an elevational front view and an elevational rear view of the vertical ruler.
FIGS. 4C and 4D are, respectively, cross-sections of the FIG. 4A vertical ruler at lines 4C—4C and 4D—4D.
Figure 4D:
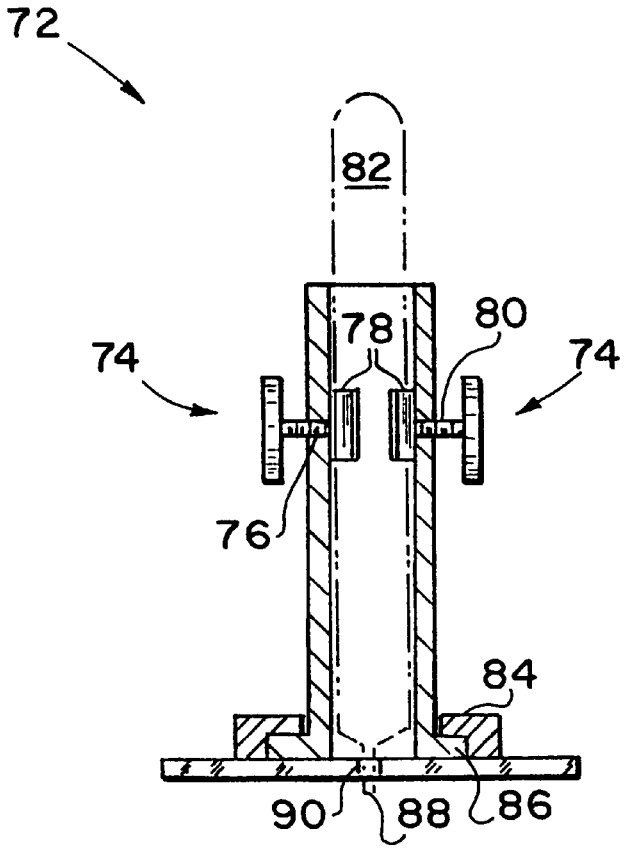

FIGS. 2 and 3A show the protractor 54 having a measuring scale with apertures 54 every 15° (from 30° to 150°) on its upper surface 58. A tongue portion 60 with a perforation 62 extends from the base edge 64 for alignment with the pivot pin 32. The protractor 54 slides along and above the horizontal ruler 20 by having a foot extension 66 on its lower surface 68 as best shown in the cross-sectional view of FIG. 3B. The horizontal ruler 20 has a slot 70 shown in FIGS. 2 and 5 for accommodating and securing the foot extension 66 of the protractor 54.

Turning to FIGS. 4A–4D, the vertical ruler 26 with a pen holder 72 having a square cross section and two fastening elements 74 inserted in opposed threaded apertures 76 are provided to move in the slot 38. A fastening element 74 has an adjustment knob on the outside and a concave flange 78 connected by a threaded stem 80. The fastening elements 74 in the pen holder 72 prevent any twisting of the pen-82 (in shadow in FIG. 4D). The pen holder 72 slidably engages the lips 84 of the slot 38 with its flanged feet 86. The pen point 88 (in shadow) protrudes through the slotted aperture 90 of the vertical ruler 26.

Thus, the vertical ruler 26 can measure accurate angles for a pen 82 in the pen holder 72 to mark on a drawing sheet.

It is to be understood that the present invention is not limited to the embodiment described above, but encompasses any and all embodiments within the scope of the following claims.

I claim:

1. An all-in-one drawing apparatus comprising:

a rectangular drawing board having opposite ends, said opposite ends being perpendicular to a horizontal axis;

a flat rectangular ruler disposed horizontally on and co-extensive with said drawing board and having a holding means on each end;

a vertically disposed flat ruler having an upper surface, a square distal end and a round proximate end, said round proximate end having a pivoting means therein and abutting the horizontally disposed ruler, said vertical flat ruler including a perforated slot for accommodating a point of a pen;

a contiguous centered strip on the upper surface of said vertical ruler, said strip having a center slot aligned with the perforated slot of the vertical ruler and an opposite proximate end extending beyond said round proximate end of said vertical flat ruler, said proximate end of said strip including a notch;

a protractor having a measuring scale on its upper surface and having a tongue portion with a perforation, said perforation being in alignment with the pivoting means of said vertical ruler, said protractor further having a foot extension on its lower surface;

said flat rectangular ruler having a slot for accommodating said foot extension of said protractor; and a pen holder element slidably engaging said slot of said strip; whereby said vertical ruler can measure accurate angles for the pen when in said pen holder to mark on a drawing sheet.

2. The all-in-one drawing apparatus according to claim 1, wherein the contiguous centered strip includes a square distal end that is substantially co-extensive with the distal end of the underlying flat vertical ruler.

3. The all-in-one drawing apparatus according to claim 1, including an index mark in said notch for alignment with a value on the measuring scale of the protractor.

4. The all-in-one drawing apparatus according to claim 1, including means defining apertures in the protractor at 15° intervals.

5. The all-in-one drawing apparatus according to claim 4, including a locking tab on the contiguous centered strip adjacent to the notch, for immobilizing the contiguous centered strip on the underlying protractor for indicating a predetermined angular value.

6. The all-in-one drawing apparatus according to claim 5, wherein the locking tab has a locking pin for penetrating a selected one of the apertures in the protractor.

7. The all-in-one drawing apparatus according to claim 6, including a lip on the locking tab for enabling the movement of the locking pin.

8. The all-in-one drawing apparatus according to claim 1, including a complementary scale on the protractor.

9. The all-in-one drawing apparatus according to claim 1, including each of said opposite ends of said rectangular drawing board being bolstered with a holding edge.

10. The all-in-one drawing apparatus according to claim 9, wherein each holding edge is planar.

11. The all-in-one drawing apparatus according to claim 1, wherein said holding means of the horizontally disposed ruler are a lip on each end.

12. The all-in-one drawing apparatus according to claim 1, wherein said holding means of the horizontally disposed ruler are a lip on each end thereof.

* * * * *